US005390867A

United States Patent [19]

Zhang et al.

[11] Patent Number: 5,390,867

[45] Date of Patent: Feb. 21, 1995

[54] YARN TAKE-UP MACHINE

[75] Inventors: Weiming Zhang, Uji; Minoru Kuninaga, Oumihachiman; Kinzo Hashimoto, Kyoto, all of Japan

[73] Assignee: Murata Kikai Kabushiki Kaisha, Kyoto, Japan

[21] Appl. No.: 984,850

[22] Filed: Dec. 3, 1992

[30] Foreign Application Priority Data

Dec. 5, 1991 [JP] Japan ..... 3-349253

[51] Int. Cl.[6] ..... B65H 54/00; B65H 67/048

[52] U.S. Cl. ..... 242/18 R; 242/18 A

[58] Field of Search ..... 242/18 R, 18 DD, 65, 242/18 A

[56] References Cited

U.S. PATENT DOCUMENTS

| | | | |
|---|---|---|---|
| 3,940,074 | 2/1976 | Laski et al. | 242/18 DD |
| 4,022,390 | 5/1977 | Matas-Gabalda | 242/18 DD |
| 4,087,055 | 5/1978 | Yasuda et al. | 242/18 DD |
| 4,342,429 | 8/1982 | Katoh et al. | 242/18 DD |
| 4,394,985 | 7/1983 | Graf et al. | 242/18 DD |
| 4,613,089 | 9/1986 | Münnekehoff | 242/18 DD |
| 4,718,615 | 1/1988 | Hefti et al. | 242/18 DD |
| 5,004,170 | 4/1991 | Graf et al. | 242/18 DD |
| 5,018,677 | 5/1991 | Fahmuller | 242/18 DD |

*Primary Examiner*—Stanley N. Gilreath
*Attorney, Agent, or Firm*—Spensley Horn Jubas & Lubitz

[57] ABSTRACT

A yarn take-up machine capable of decreasing vibration at the time of elevating frame resonance and operating at a wide range of take-up speeds from low to high speeds. Bobbin holders for holding a bobbin to package winding are mounted on a machine frame and a frame member for holding a touch roller rotating in contact with the bobbin holders is supported on the machine frame. In this take-up machine, a dynamic vibration absorber is mounted in the vicinity of the forward end of the frame member.

5 Claims, 11 Drawing Sheets

YARN TAKE-UP MACHINE

BACKGROUND OF THE INVENTION

1. Field of the Invention

The present invention relates to a yarn take-up machine for taking up at a high speed a yarn coming from a spinning beam and, more particularly, to a take-up machine having an elevating frame designed to be subject to reduced vibration at the time of resonance.

2. Related Art Statement

A yarn take-up machine is primarily composed of a turret disc which turns around a horizontal shaft in relation to a machine frame; two bobbin holders projectingly installed from the turret disc; an elevating frame which is guided along a column in the machine frame and vertically moves upwards and downwards; a touch roller supported on the elevating frame; and a traverse device supported on the elevating frame. That is, the bobbin holders are projectingly installed on the machine frame indirectly through the turret disc.

In the conventional yarn take-up machine described above, the speed of the bobbin holders during the taking-up operation from the start of winding to the end of winding changes within a wide range. The touch roller for applying a proper contact pressure to the packages P wound on the bobbins B mounted on the bobbin holders will be affected by this change in the take-up speed. That is, the bobbin holders will become a source of vibration, causing the elevating frame holding the touch roller to resonate. In conventional take-up machines, the elevating frame is designed so that the natural frequency of the elevating frame will become less than the rotational vibration frequency of the bobbin holders.

In recent years-what has been sought is a yarn take-up machine which can be operated within a wide speed range from a low speed to a high speed; however, with this increase in the speed range, the rotational vibration frequency of the bobbin holders also tends to increase. For example, in a wide range of taking-up speed the rotational vibration frequency of the bobbin holders ranges from minimum 24 Hz to maximum 290 Hz. There is, therefore, such a problem that it is practically difficult to design the elevating frame having no natural frequency to operate at such a wide range of rotational vibration frequency, and there exists a limit to the use of a high-speed spun yarn take-up machine.

OBJECT AND SUMMARY OF THE INVENTION

In view of the above-described problem inherent in the heretofore known techniques, it is an object of the present invention to provide a spun yarn take-up machine capable of operating at a wide range of taking-up speeds with little vibration in the event of resonance of the elevating frame.

To accomplish the above object, the spun yarn take-up machine of the present invention has a frame member supported on a machine frame for holding a touch roller which rotates in contact with a bobbin holder mounted on the machine frame for holding bobbin packages, and also has dynamic vibration absorber mounted on the frame member.

Proper resonance can be obtained by providing proper specifications including mass, spring constant and damping constant of the dynamic vibration absorber in relation to the frame member.

DETAILED DESCRIPTION OF PREFERRED EMBODIMENT

Figure 6:
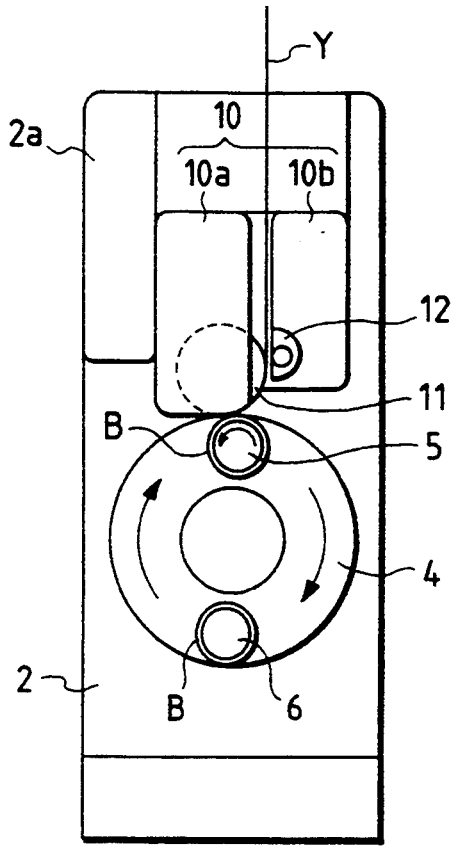
FIG. 6 PRIOR ART
FIG. 6 is a front view of a conventional yarn take-up machine.
Figure 7:
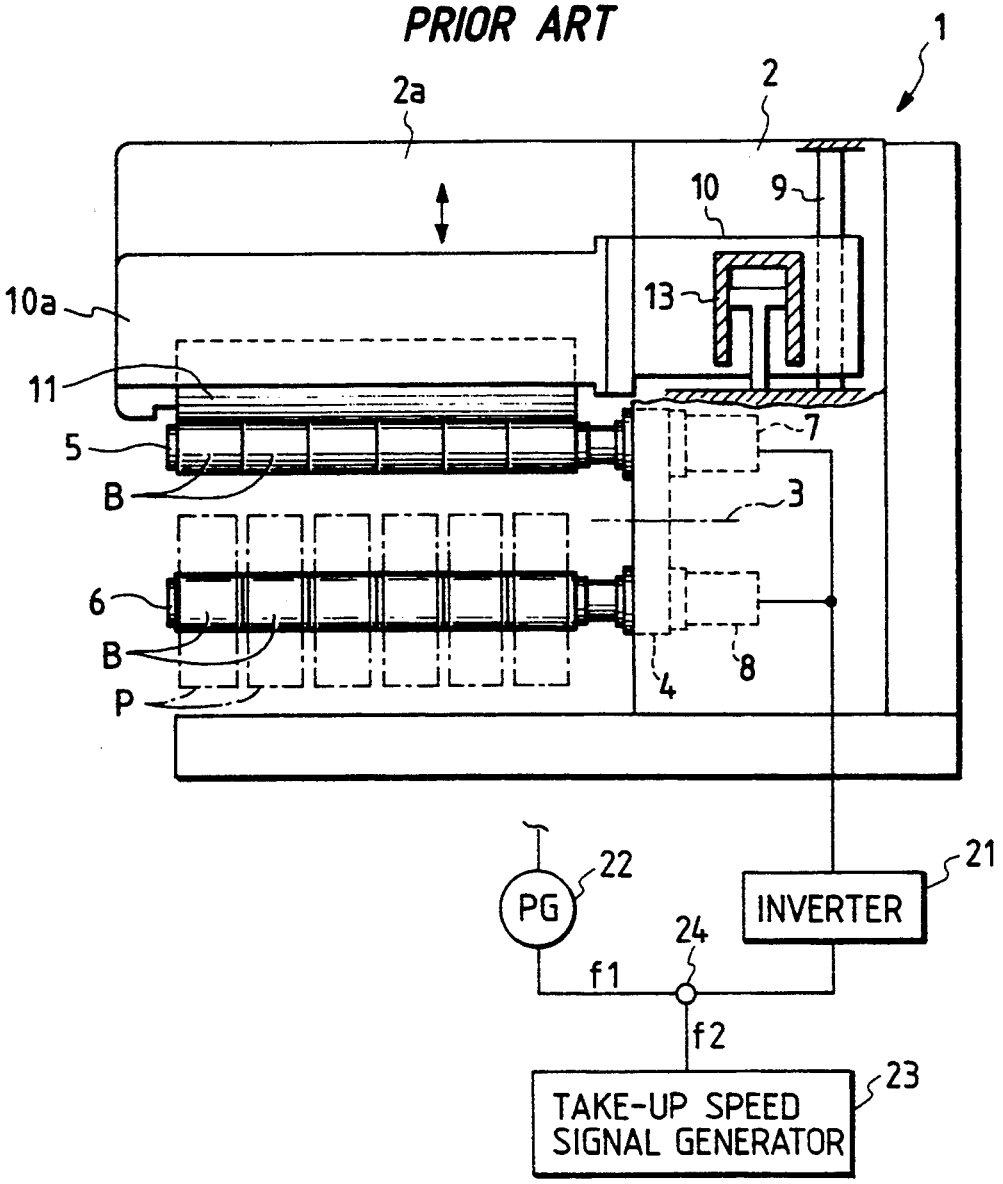
FIG. 7 PRIOR ART
FIG. 7 is a side-view of a conventional elevating mechanism.

Referring to FIGS. 6 and 7, a conventional yarn take-up machine will be explained first. FIG. 6 is a front view and FIG. 7 is a side view.

In FIGS. 6 and 7, a yarn take-up machine 1 is primarily composed of a turret disc 4 which turns around a horizontal shaft 3 in relation to a machine frame 2; two bobbin holders 5 and 6 projectingly installed from the turret disc 4; induction motors 7 and 8 fixedly mounted on the back of the turret disc 4, for driving and turning the bobbin holders 5 and 6; an elevating frame 10 which is guided along a column 9 in the machine frame 2 and vertically moves upwards and downwards, a touch roller 11 supported on a first frame member 10*a* of this elevating frame 10; and a traverse device 12 supported on a second frame member 10*b* of the elevating frame 10. That is, the bobbin holders 5 and 6 are projectingly installed on the machine frame 2 indirectly through the turret disc 4. The weight of the whole body of the elevating frame 10 for supporting the touch roller 11 and the traversing device 12 is supported by means of a contact pressure cylinder 13 disposed on the elevating frame 10 side, so that a difference between this weight and the lifting force of the contact pressure cylinder 13 becomes the contact pressure of the touch roller 11 on a package P. The character B refers to a bobbin; P, a package formed on the bobbin; Y, a yarn from the spinning beam; and a reference numeral 2*a*, a fixed arm section projectingly installed on the machine frame 2, on the forward end of which an operation panel is installed.

Next, the mode of take-up operation of the yarn take-up machine 1 will be briefly explained. In FIG. 7, an inverter 21 for motor speed control is connected to the induction motors 7 and 8 of the bobbin holders 5 and 6; and a touch roller 11 is fitted with a pulse generator 22 for detecting the number of revolutions (or the yarn speed). A signal f1 produced by the pulse generator 22 is compared with a set signal f2 of the take-up speed signal generator 23, and an instruction is given from a comparator 24 to the inverter 21 to maintain a specific take-up speed. That is, with an increase in the diameter of the package P, the bobbin holders 5 and 6 are designed to decrease in the number of revolutions. When the package P has been fully wound, the turret disc 4 turns through 180 degrees and the bobbin holder 6 of the full package P waits in the illustrated stand-by position, while the bobbin holder 5 of empty bobbin B comes in the illustrated take-up position, in which position the yarn is fed out from the full package P to the empty bobbin B, being taken up continuously. The bobbin holder 6 carrying the full package P gradually decreases its speed, finally coming to a stop. Then the full package P and the empty bobbin B are changed.

Figure 1:
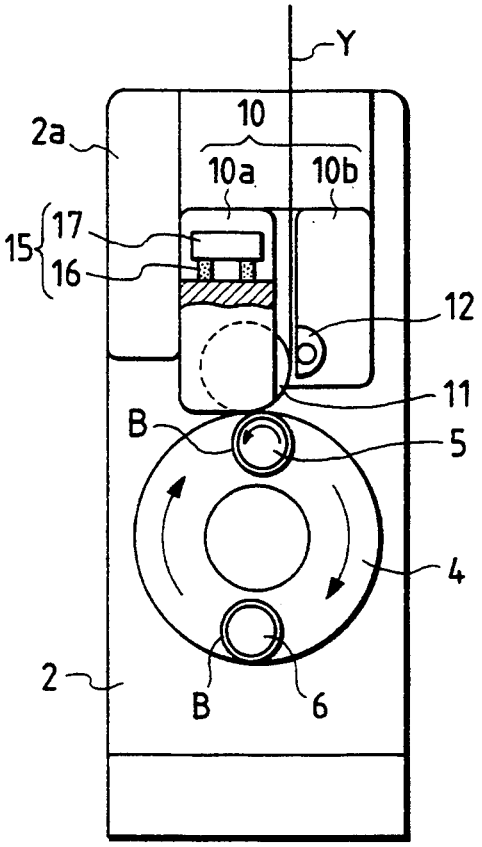
FIG. 1 is a front view of a yarn take-up machine of the present invention.

Hereinafter a preferred embodiment of a yarn take-up machine according to the present invention will be explained with reference to the accompanying drawings. FIG. 1 is a front view of the yarn take-up machine of a first embodiment of the present invention, and FIG. 2 is a side view thereof.

Figure 2:
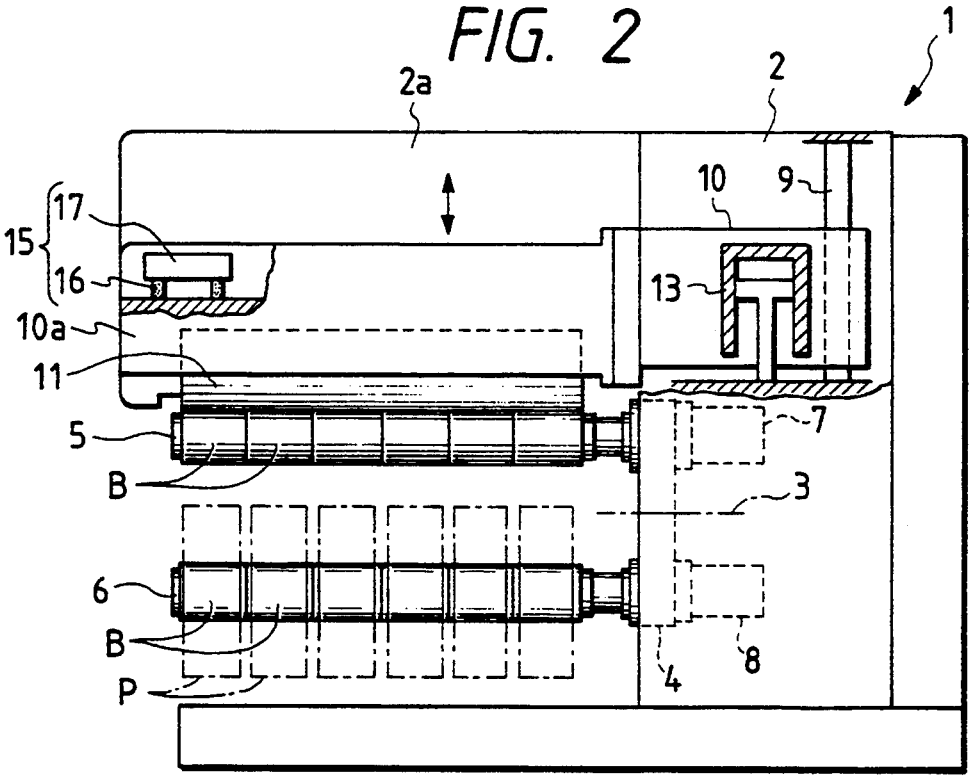
FIG. 2 is a side view of the yarn take-up machine of the present invention.

In FIGS. 1 and 2, the same members operating as those shown in FIGS. 6 and 7 are designated by the same numerals and are not described. In FIGS. 1 and 2, a difference from FIGS. 5 and 6 lies in the mounting of the dynamic vibration absorber 15 at the forward end in the first frame member 10a of the elevating frame 10.

The dynamic vibration absorber 15 is of the simple constitution comprising four rubber cushions 16 attached on the first frame member 10*a*, and iron blocks 17 attached to the rubber cushions 16. A preferable location of this dynamic vibration absorber 15 is the first frame member 10*a* directly holding the touch roller 11, becoming more effective as it goes closer to the forward end. It should be understood that, as illustrated, the arrangement of the dynamic vibration absorber 15 is not limited to horizontal arrangement, but may be lateral arrangement at the forward end of the first frame member 10*a* and that the dynamic vibration absorber 15 may be covered with a cover.

Figure 3:
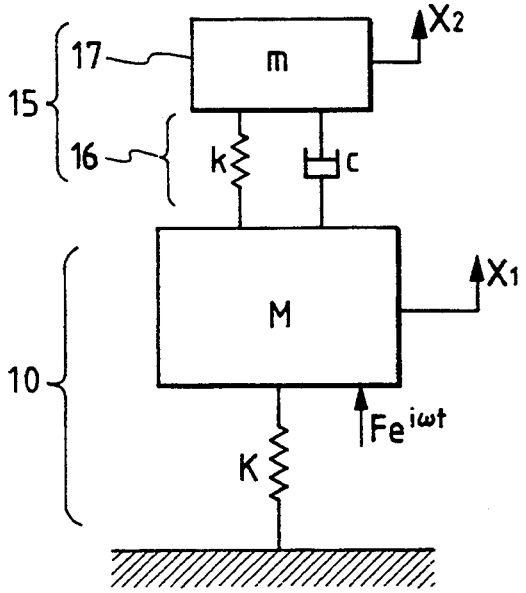
FIG. 3 is a view showing a model of a vibration system.

Referring to FIG. 3, a model of the elevating frame 10 on which the dynamic vibration absorber 15 is mounted will be explained. The iron blocks 17 serve as weights of mass m; the rubber cushions 16, as springs of spring constant k and dampers of damping constant and the elevating frame 10 serves as a spring of spring constant K to be determined by the weight of mass M and a support construction thereof. In this model, the optimum design condition of the dynamic vibration absorber 15 will satisfy the following formulas (1) and (2).

$$\text{Optimum natural frequency} = (1/(1+\mu)) \times \Omega_n \quad (1)$$

$$\text{Optimum damping ratio} = 3\mu/8(1+\mu))^{\frac{1}{2}} \quad (2)$$

where $\mu$: Mass ratio of iron block and elevating frame (m/M)

$\Omega$Natural frequency of elevating frame $((K/M)^{\frac{1}{2}})$

Now, referring to FIG. 4, the natural frequency response pattern of the elevating frame 10 mounted with the dynamic vibration absorber 15 will be explained. A dotted line indicates the pattern for the elevating frame 10 not equipped with the dynamic vibration absorber 15, and a full line shows the pattern for the elevating frame 10 equipped with the dynamic vibration absorber 15. A sharp resonance phenomenon varies to a gradual increase in amplitude in a trapezoidal form. And the larger the mass ratio of the iron blocks and the elevating frame, the lower the amplitude. However, a remarkable decrease in the amplitude is seen until the mass ratio reaches 0.1. Particularly when the mass ratio of 0.2 is exceeded, the amplitude does not decrease so much; only the weight of the whole elevating frame increases. The most effective decrease of vibration amplitude is obtained at the mass ratio of 0.1 to 0.2.

Figure 5:
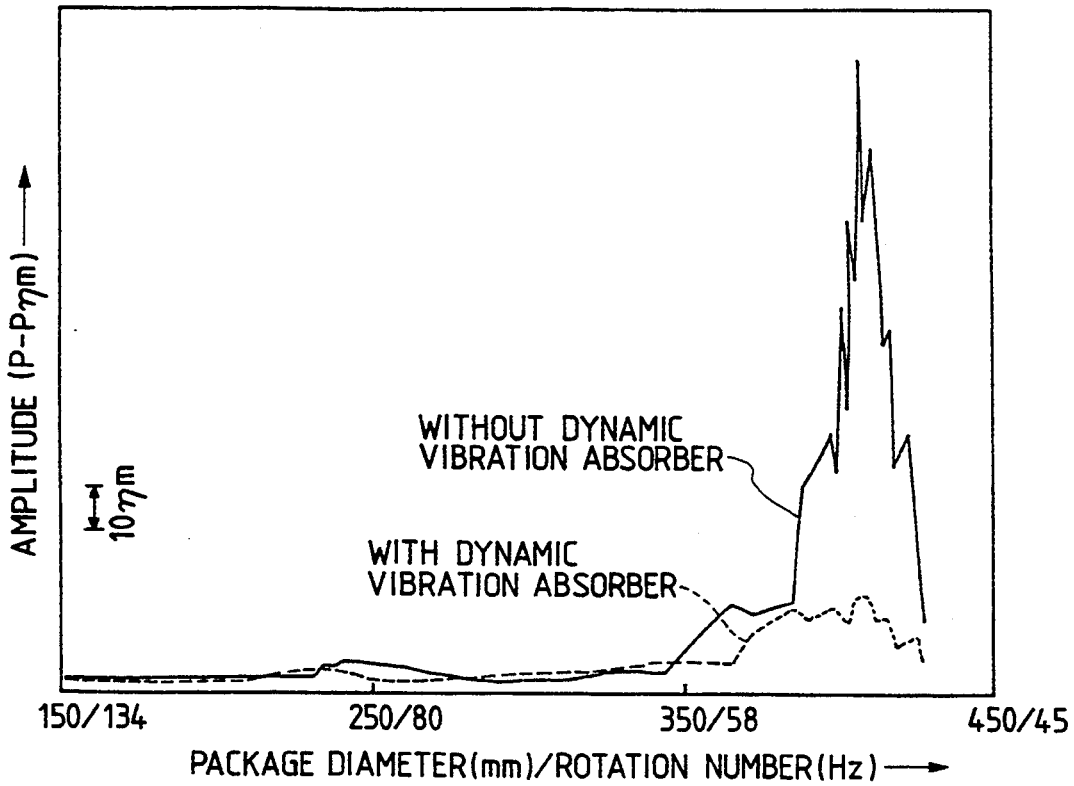
FIG. 5 is a graph showing vibration of the elevating frame in actual use.

FIG. 5 shows vibration of the elevating frame equipped with the vibration restraining device according to the present invention and the vibration of the conventional elevating frame not equipped with the vibration restraining device.

When the aforementioned optimum conditions are applied to the yarn take-up machine in practical use, the weight of the iron blocks of the dynamic vibration absorber is about 5 to 10 kg. Also when a 5 kg dynamic vibration absorber is installed on the elevating frame having the natural frequency of 44 Hz (the elevating frame is about 40 kg, and has a mass ratio of about 0.13) in the positions shown in FIGS. 1 and 2 and a nylon yarn 6 is taken up at the winding speed of 3800 m/min., the amplitude of the elevating frame 10 considerably decreased.

In the above-described embodiment, the yarn take-up machine was a so-called spindle-drive type in which the bobbin holder for holding bobbins is directly driven by an induction motor. The present invention is also applicable to a so-called friction drive type whose bobbin is indirectly driven with the positively driven touch roller held in contact with the bobbin mounted on the bobbin holder. Furthermore, the present invention is applicable not only to an automatic changer type which automatically switches from a full package to an empty bobbin by turning the turret disc but also to a yarn take-up machine of such a type that only one bobbin holder is used and therefore bobbin change is carried out with the take-up machine stopped.

Furthermore, the device of the present invention may be applied to such a type of the yarn take-up machine as the frame 10 is secured to the machine frame 2 and the bobbin holders 5 and 6 are going to separate from the touch roller 11 in accordance with the increase of the package diameter.

In the yarn take-up machine of the present invention, the dynamic vibration absorber is mounted in the vicinity of the forward end of the elevating frame, so that resonance of the elevating frame can be restrained by providing proper specifications including the mass, spring constant, and damping constant of the dynamic vibration absorber. The yarn take-up machine, therefore, is released from the design limit of the natural frequency of the elevating frame, corresponding to a wide range of take-up speeds from low to high.

Figure 8:
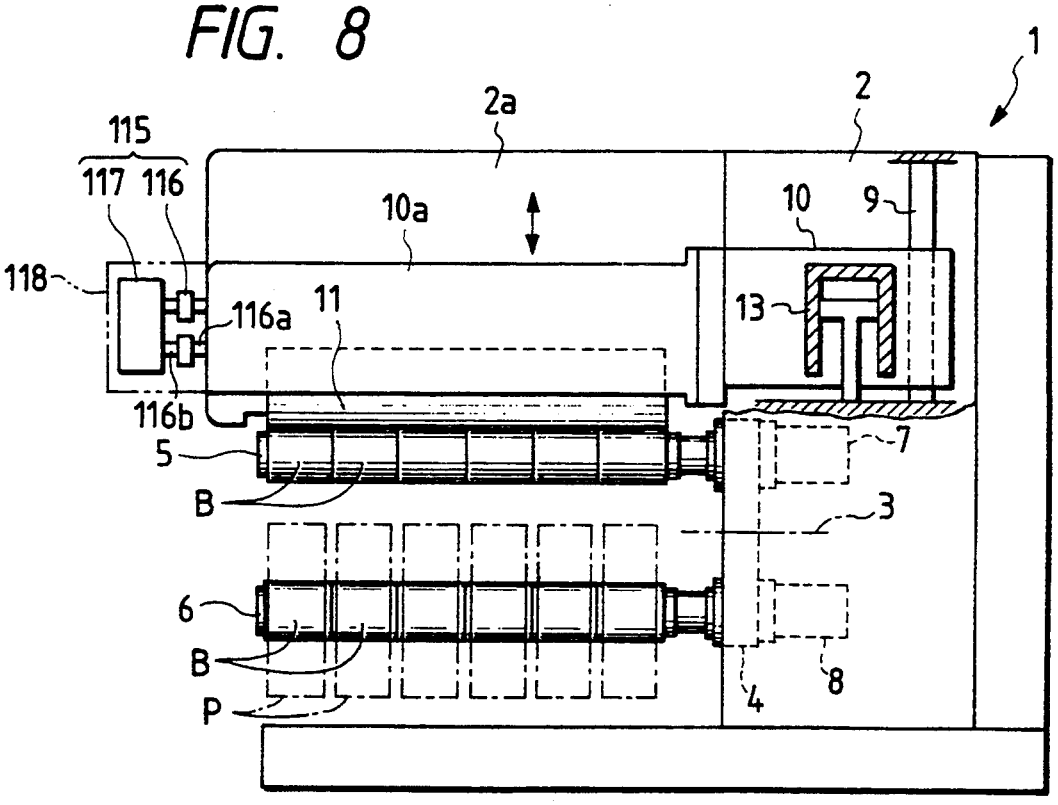
FIG. 8 is a side view of a second embodiment of the yarn take-up machine according to the present invention.
Figure 9:
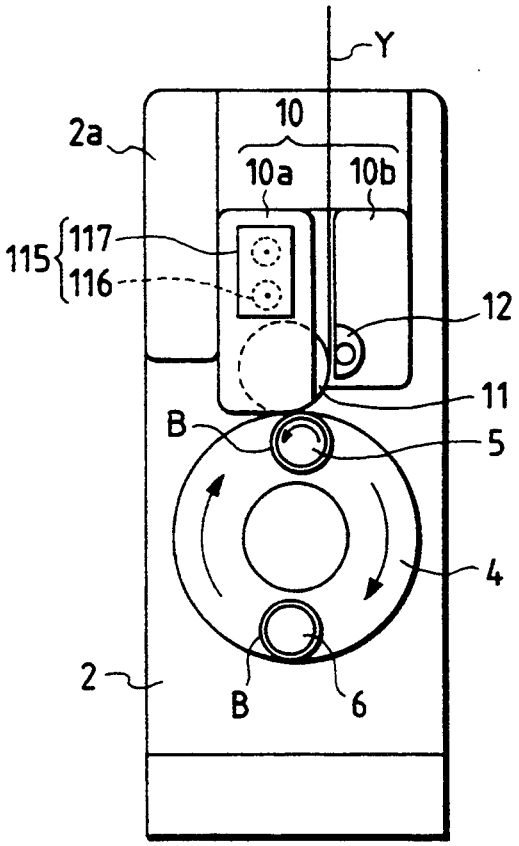
FIG. 9 is a front view of the yarn take-up machine of FIG. 8.

Referring to the accompanying drawings, the second embodiment of the yarn take-up machine according to the present invention will be explained. FIG. 8 is a side view of the yarn take-up machine of the present invention. FIG. 9 is a front view thereof.

In FIGS. 8 and 9, the members operating in the same manner as those shown in FIGS. 6 and 7 are designated by the same reference numerals and will not be explained. Also in FIGS. 8 and 9, a difference from FIGS. 6 and 7 is the mounting of a dynamic vibration absorber 115 at the forward end of a first frame member 10*a* of an elevating frame 10 supported cantilevered, with elastic rubber members 116 and a weight 117, which are supported also cantilevered, arranged in series in order of mention.

The dynamic vibration absorber 115 is of a simple constitution comprising a couple of elastic rubber members 116 and a weight 117. For the weight 117 is used an ordinary iron block. For the elastic rubber member 116 a commercial rubber cushion is usually adopted. In the illustrated example, independent mounting bars 116*a* and 116*b* are embedded on the right and left of the elastic rubber member 116. The elastic rubber member 116 is attached by the mounting bar 116*a* at the forward end of the first frame member 10*a*, while the weight 117 is installed by the mounting bar 116*b*. That is, the dynamic vibration absorber 115 is mounted cantilevered at the forward end of the first frame member 10*a* also supported cantilevered. The adoption of this cantilevered type allows easy mounting of the dynamic vibration absorber 115 at the forward end of the first frame member 10*a*, thereby improving the coefficient of dynamic vibration absorption. In this case the number of the elastic rubber members 116 is not limited to two, but may be changed to a desired number.

Mounting the dynamic vibration absorber 115 in a cantilevered manner at the forward end of the first frame member 10*a* which is mounted cantilevered, will form a projecting portion, and therefore it is desirable to cover the whole part of the dynamic vibration absorber 115 with a cover 118. Furthermore, when the space in this cover 118 is hermetically closed, the elastic rubber member 116 which is liable to deterioration can be shut off from external atmosphere.

Figure 10:
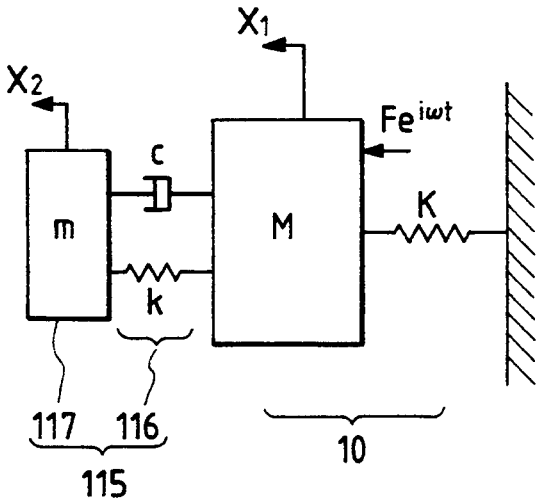
FIG. 10 is a view showing a model of the vibration system of FIG. 8.

Next, the model of the elevating frame 10 mounted with the dynamic vibration absorber 115 will be explained with reference to FIG. 10. The weight 117 is of the mass m; the elastic rubber 116 serves as a spring of the spring constant k and a damper of the damping constant c; and the elevating frame 10 serves as a spring of the spring constant K which is determined by the weight of the mass M and its support construction. In this model, the optimum design conditions of the dynamic vibration absorber 115 will satisfy the following formulas 1 and 2 .

$$\text{Optimum natural frequency} = (1/(1+\mu)) \times \Omega_n \quad (1)$$

$$\text{Optimum damping ratio} = (3\mu/8\,(1+\mu))^{\frac{1}{2}} \quad (2)$$

where $\mu$: Mass ratio of iron block and elevating frame (m/M) $\Omega_n$: Natural frequency of elevating frame $((K/M)^{\frac{1}{2}})$ In the present embodiment, the vibration frequency response pattern is the same as that in FIGS. 4 and 5.

In the yarn take-up machine of this embodiment of the present invention, the dynamic vibration absorber is mounted cantilevered at the forward end of the frame member with the elastic rubber member and the weight arranged in series also cantilevered in order of mention. In the case of a cantilevered frame member whose resonance amplitude increases, the dynamic vibration absorber mounted also cantilevered absorbs the resonance most efficiently and therefore it is possible to restrain the resonance by the use of a dynamic vibration absorber of a simplified construction. As a result, the yarn take-up machine is freed from the design limit as to the natural frequency of the elevating frame, and therefore can correspond to a wider take-up speed range from low to high speeds.

Figure 11A:
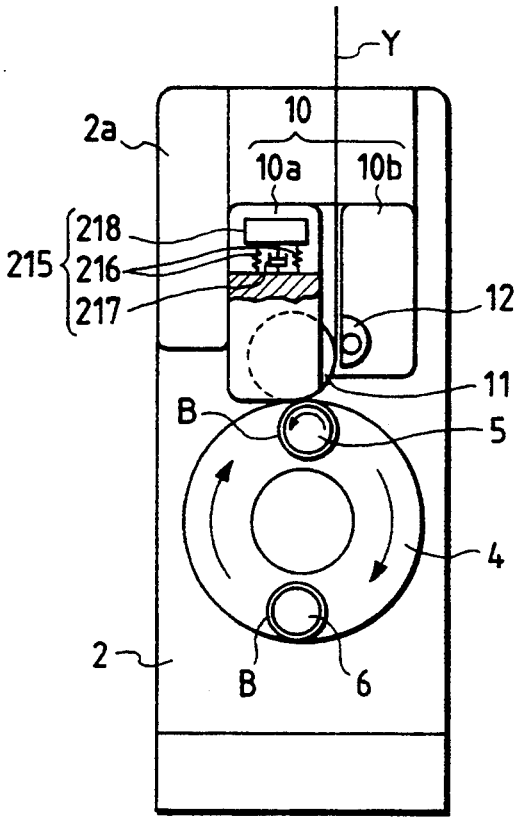
FIGS. 11*a* and 11*b* are front views of an example of a yarn take-up machine using a third embodiment of the vibration restraining device according to the present invention.
Figure 11B:
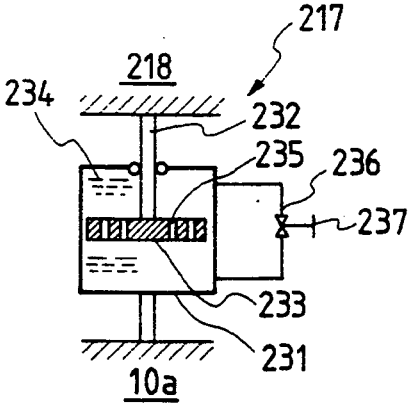
Figure 12:
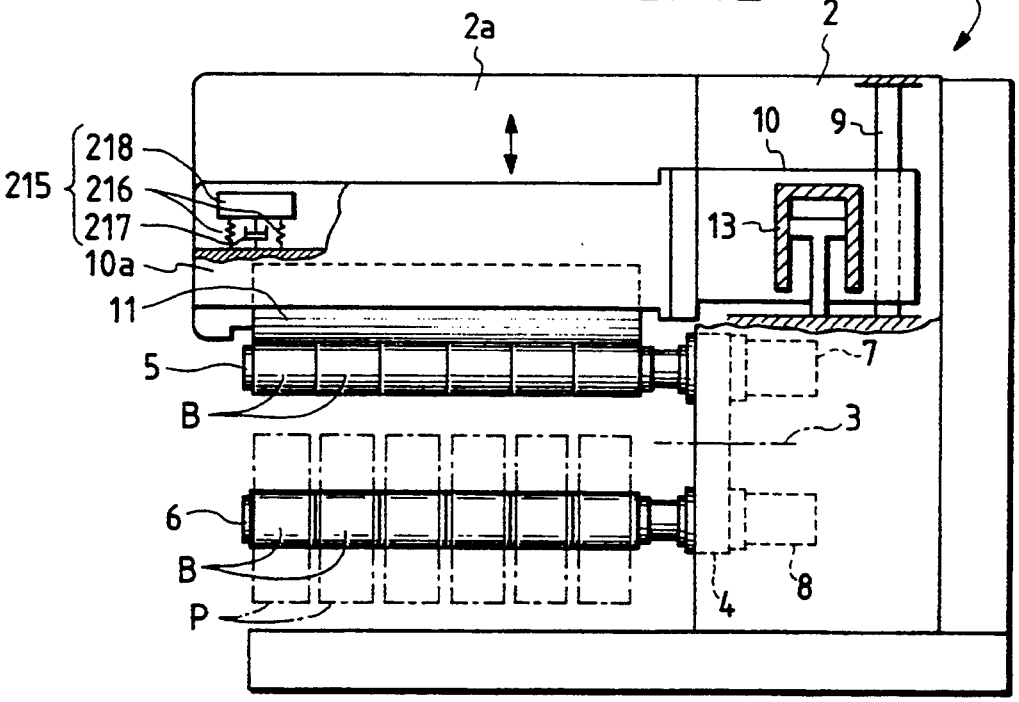
FIG. 12 is a side view of the yarn take-up machine of FIGS. 11*a*, 11*b* using the vibration restraining device of the present invention.

Next, the third embodiment of the yarn take-up machine according to the present invention will be explained. FIGS. 11*a* and 11*b* are front views showing the yarn take-up machine using the vibration restraining device of the embodiment of the present invention; FIG. 12 is a side view thereof.

In FIGS. 11*a*–12, the same members operating as those shown in FIGS. 6 and 7 are designated by the same numerals and are not described. In FIGS. 11*a*–12, a difference from FIGS. 6 and 7 lies in the mounting of the vibration restraining device with the dynamic vibration absorber 215 mounted at the forward end in the first frame member 10*a* of the elevating frame 10.

The dynamic vibration absorber 215 is of a simple constitution including four springs 216 and one dash pot 217 mounted in parallel on a first frame member 10*a* , and an iron weight 218 supported by the springs 216 and the dash pot 217. For example, the weight 218 is supported with the springs 216 at four corners of its lower surface, and the lower surface of the weight 218 is supported at center by means of the dash pot 217. The dynamic vibration 215 is recommended to be located on the first frame member 10*a*, and an iron weight 218 supported by the springs 216 and the dash pot 217. For example, the weight 218 is supported with the springs 216 at four corners of its lower surface, and the lower surface of the weight 218 is supported at center by means of the dash pot 217. The dynamic vibration 215 is recommended to be located on the first frame member 10*a* which directly holds the touch roller 11; the closer to the forward end, the more effective. As illustrated, the arrangement of the dynamic vibration absorber 215 is not limited to horizontal, but the dynamic vibration absorber 215 may be laterally mounted at the forward end of the first frame member 10*a*. The dash pot 217 is primarily composed of a cylinder 231 vertically installed on the first frame member 10*a*, a rod 232 suspended from the weight 218, and a piston 233 located in the cylinder 231 which is connected to the rod 232. The cylinder 231 is full of oil 234. A piston 233 is provided with a number of holes 235; the damping constant is determined by the opening area of these holes 235 and the viscosity of the oil 234. The upper and lower chambers of the cylinder 231 divided by the piston 233 are connected by a pipe 236. The damping constant can be adjusted by means of a needle valve 237 connected to this pipe 236.

Figure 13:
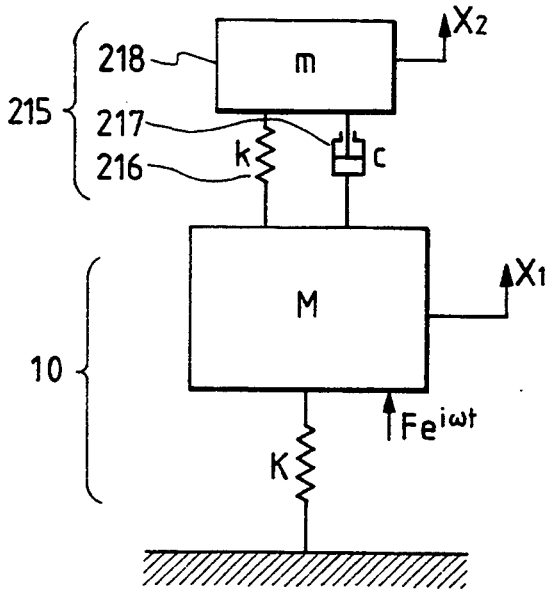
FIG. 13 is a view showing a model of the vibration system of FIGS. 11*a*, 11*b*.

Referring to FIG. 13, a model of the elevating frame 10 on which the dynamic vibration absorber 15 is mounted will be explained. The iron weight 218 is of the mass m; the spring 216 has a spring constant k; the dash pot 217 is of the damping constant c; and the elevating frame 10 serves as a spring of spring constant K to be determined by the weight of mass M and a support construction thereof. In this model, the optimum design condition of the dynamic vibration absorber 15 will satisfy the following formulas (1) and (2).

$$\text{Optimum natural frequency} = (1/(1+\mu)) \times \Omega_n \quad (1)$$

$$\text{Optimum damping ratio} = (3\mu/8(1+\mu))^{\frac{1}{2}} \quad (2)$$

where $\mu$: Mass ratio of iron block and elevating frame (m/M)

$\Omega_n$: Natural frequency of elevating frame $((K/M)^{\frac{1}{2}})$

Now, referring to FIG. 14, the natural frequency response pattern of the elevating frame mounted with the dynamic vibration absorber will be explained. A dotted line indicates the pattern for the elevating frame not .equipped with the dynamic vibration absorber, while a full line indicates the elevating frame equipped with the dynamic vibration absorber. In case of a small damping constant c, there appear two peaks, while in case of a large damping constant c, there appears one peak. When the damping constant c is proper, there appears a trapezoidal curve without a peak. Particularly in the case of a commercial rubber cushion, the damping constant c is some what insufficient, but a dynamic vibration absorber 15 having the optimum damping constant c can be obtained by separating the springs and the dash pot. The vibrational amplitude can be reduced most effectively when the mass ratio (m/M) is 0.1 to 0.2. The vibrational amplitude lowers remarkably until the mass ratio is 0.1, after which it will not decrease so much and the whole body of the elevating frame will increase in weight even when the mass ratio exceeds 0.2. In the present embodiment also, the vibrational amplitude of the elevating frame 10 decreases largely as that shown in FIG. 5.

In the vibration restraining device of the yarn take-up machine of this embodiment of the present invention, there is mounted a dynamic vibration absorber including a weight, a spring, and a dash pot for imparting a damping force, which are arranged in parallel with the weight, in the vicinity of the forward end of the frame member of the yarn take-up machine having a frame member which holds a touch roller rotating in contact with a package. The vibrational resonance of the frame member of the yarn take-up machine can be restrained by providing such proper specifications as the mass of the weight of the dynamic vibration absorber, the spring constant of the spring, and the damping constant of a dash port to the frame member, and the damping constant of a common rubber cushion which has been somewhat insufficient can be set to a specific value. Consequently, the yarn take-up machine can be freed from the design limit of the natural frequency of the elevating frame, thereby enabling corresponding to wide-range take-up speeds from low to high. Also, since the damping constant can be freely set by adjusting the dash pot, it is possible to easily design the optimum vibration restraining device for yarn take-up machines of different sizes.

Figure 15:
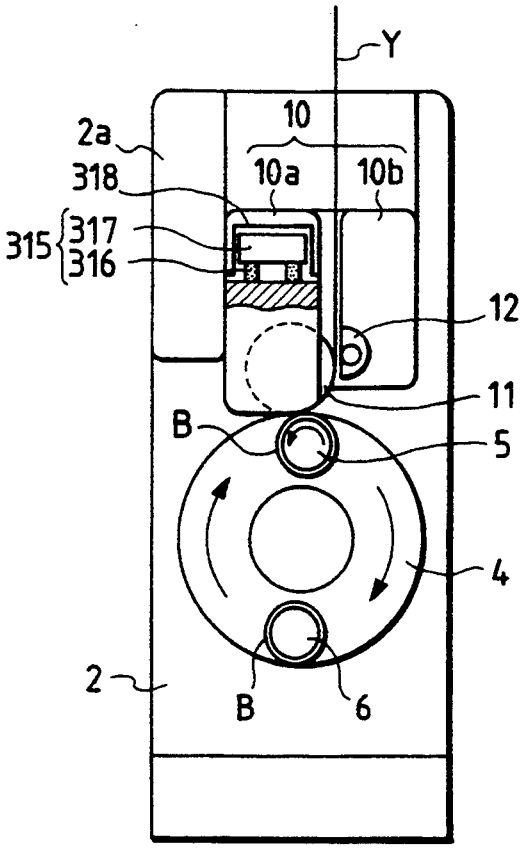
FIG. 15 is a front view of the yarn take-up machine using a fourth embodiment of the vibration restraining device according to the present invention.

Next, the fourth embodiment of the yarn take-up machine according to the present invention will be explained. FIG. 15 is a front view of the yarn take-up machine using a vibration restraining device of this embodiment of the present invention. FIG. 2 is a side view thereof.

Figure 16:
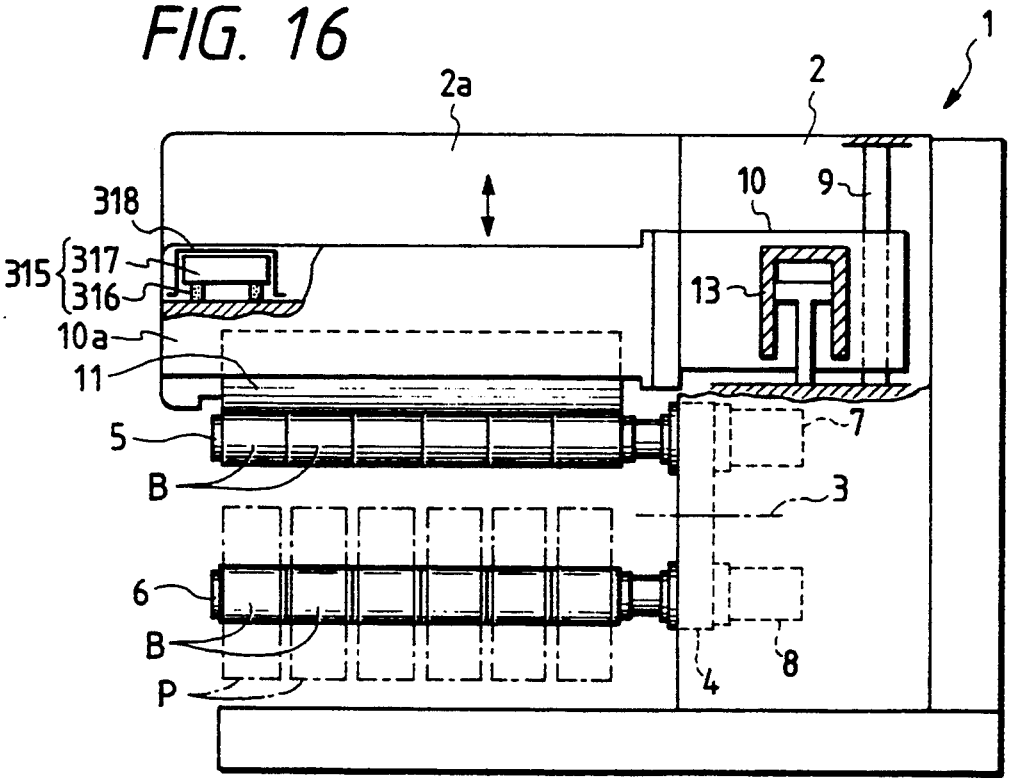
FIG. 16 is a side view of the yarn take-up machine using the vibration restraining device of FIG. 15

In FIGS. 15 and 16, members operating in the same manner as those in FIGS. 6 and 7 are designated by the same reference numerals, and will not be described. Also in FIGS. 15 and 16, a difference from FIGS. 6 and 7 is the mounting of a vibration restraining device consisting of a dynamic vibration absorber 315 housed in a cover 318 at the forward end in the first frame member **10*a* of the elevating member 10**.

The dynamic vibration absorber 315 is of a simple constitution consisting of four rubber cushions 316 mounted on the first frame member **10*a* and an iron weight 317 mounted on the rubber cushions 316. The whole body of the dynamic vibration absorber 315 is housed in a cover 318, thus forming the vibration restraining device. Between the cover 318 and the first frame member 10*a* is interposed a packing, not illustrated. The interior of the cover 318 is formed as a closed space, thereby preventing deterioration with age of the rubber cushions 316 and maintaining the specified vibration-damping performance of the dynamic vibration absorber 315. The recommended mounting position of this dynamic vibration absorber 315 is the first frame member 10*a* on which the touch roller 11 is directly supported. More effective vibration damping is insured as the mounting position approaches the forward end of the frame member 10*a*. As illustrated, the arrangement of the dynamic vibration absorber 315 is not limited to horizontal, but may be transverse and at the forward end of the first frame member 10*a***.

The above-described dynamic vibration absorber 315 is the same as the model in FIG. 3 of the elevating frame 10 on which the dynamic vibration absorber 315 is mounted.

Figure 4:
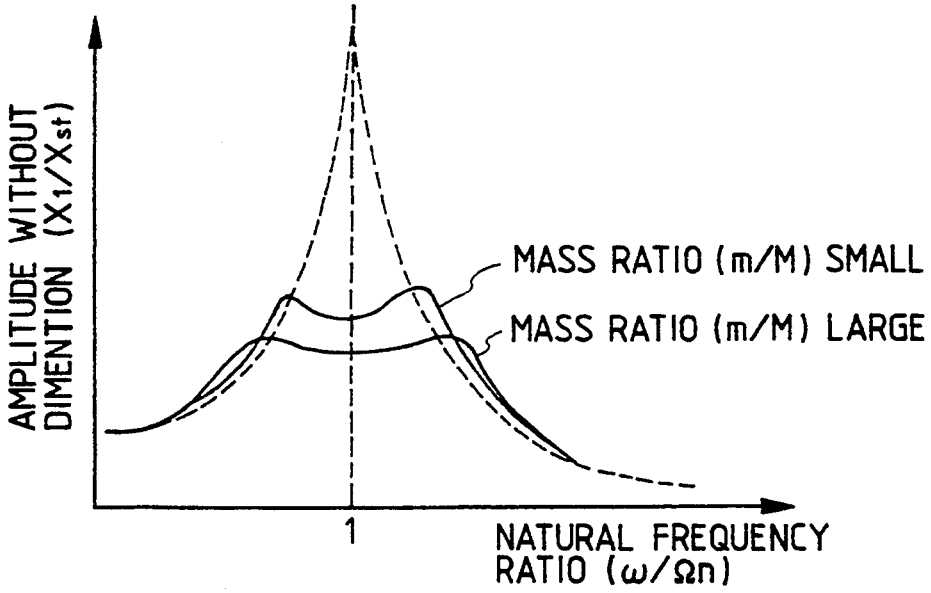
FIG. 4 is a graph showing a vibration frequency response pattern.

The vibration frequency response pattern of the elevating frame 10 on which the dynamic vibration absorber 315 is mounted is the same as that in FIG. 4.

Figure 17:
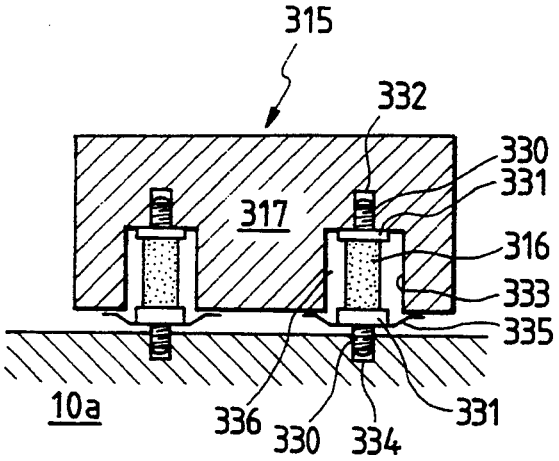
FIG. 17 is a sectional view of another the vibration restraining device of FIG. 15.

FIG. 17 is a sectional view of another vibration restraining device. Both ends of the rubber cushion 316 are bonded to a plate 331 fitted with a screw 330. Also the weight 317 is provided with a cylindrical hole 333 having a threaded hole 332. The frame member **10*a* is also provided with a threaded hole 334. The rubber cushion 316 is embedded in the cylindrical hole 333 by screwing one end of a screw 330 into the threaded hole 332. Also the weight 317 is installed on the frame member 10*a* through the rubber cushion 316 by screwing another screw 330 into the threaded hole 334. Further, the plastic sheet 335 is attached by an adhesive between the lower plate 331 and the lower surface of the weight 317. As a result, the space 336 is hermetically closed to prevent deterioration with age of the rubber cushion 316 and accordingly to maintain the specific vibration damping performance of the dynamic vibration absorber 315**.

In the vibration restraining device of the yarn take-up machine of the present invention, the dynamic vibration absorber including the weight and the rubber connected to the weight is mounted in the vicinity of the forward end of the frame member of the yarn take-up machine having the frame member for holding the touch roller which is rotating in contact with the package, and at least the rubber of the dynamic vibration absorber is housed in a hermetically closed space. The vibrational resonance of the frame member of the yarn take-up machine can be restrained by using proper specifications including the mass of the spindle of the dynamic vibration absorber, spring constant and damping constant of the rubber in relation to the frame member. Furthermore, the rubber is housed in the hermetically closed space to reduce deterioration, thereby enabling releasing the yarn take-up machine from the design limit of natural frequency of the elevating frame, so that the machine can operate at a wider speed range from low to high, and maintaining stabilized vibration damping effect for a prolonged period of time without a change in the specific vibration damping performance with age.

Figure 18A:
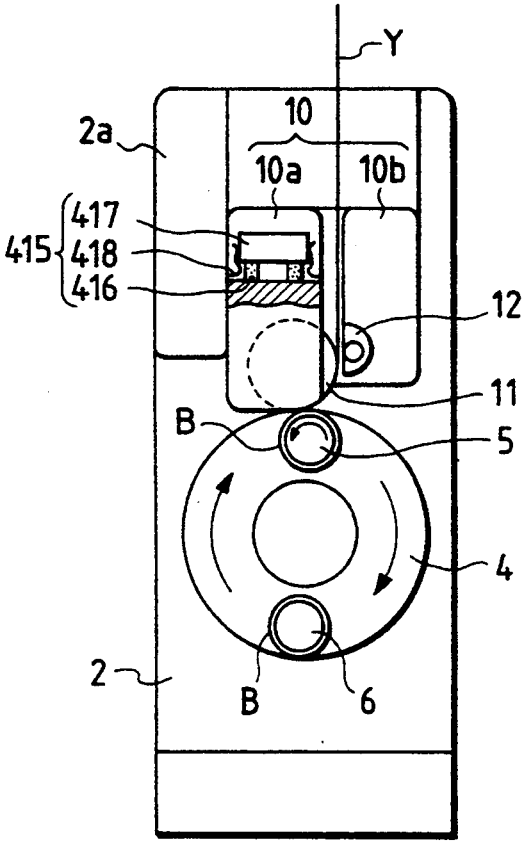
FIG. 18*a* and 18*b* are front views of yarn take-up machine using a fifth embodiment of the vibration restraining device according to the present invention.
Figure 18B:
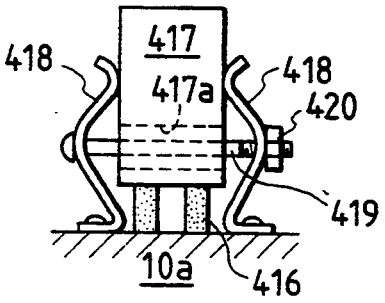

Next, the fifth embodiment of the yarn take-up machine according to the present invention will be explained. FIGS 18*a* and 18*b* are front view of the yarn take-up machine using a vibration restraining device of this embodiment of the present invention, and FIG. 19 is a side view thereof.

Figure 19:
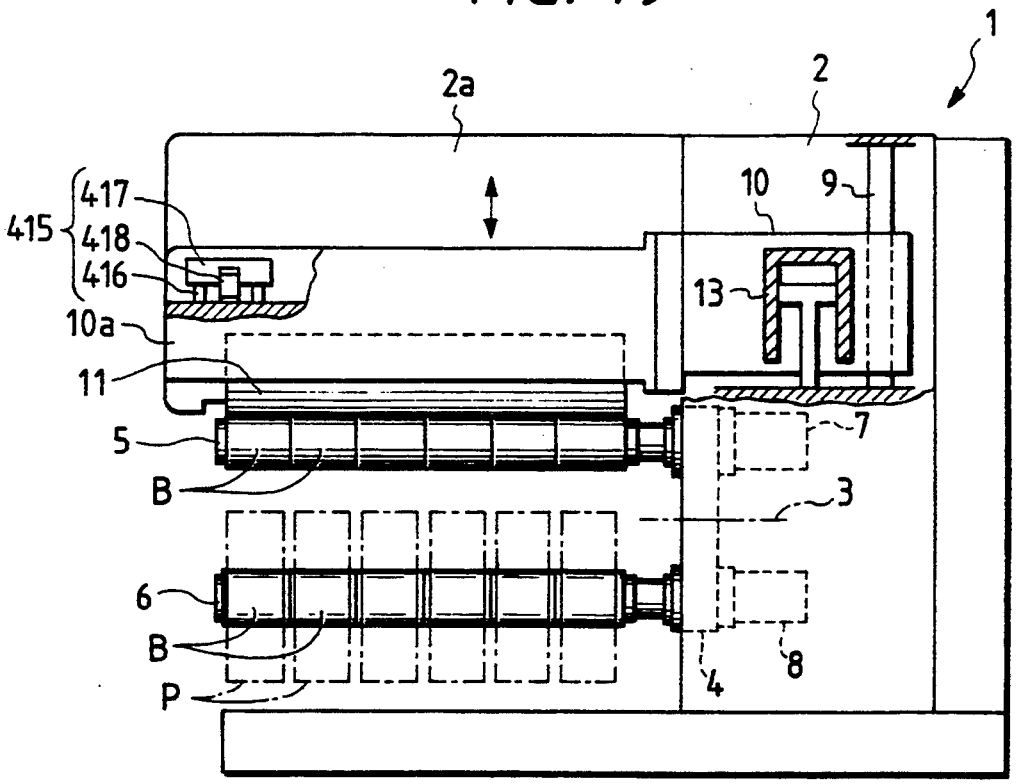
FIG. 19 is a side view of the yarn take-up machine using the vibration restraining device of FIGS. 18*a*, 18*b

In FIGS. 18*a*–19, members operating in the similar manner as those in FIGS. 6 and 7 are designated by the same numerals and will not be described. In FIGS. 18*a*–19, a difference from FIGS. 6 and 7 is the mounting of a vibration restraining device with the dynamic vibration absorber 415 at the forward end in the first frame member 10*a* of the elevating frame 10.

The dynamic vibration absorber 415 is of such a simplified construction having four rubber cushions 416 mounted on the first frame 10*a*, an iron weight 417 supported by the rubber cushion 416, and a plate spring 418 mounted in contact with the side face of the weight 417. The dynamic vibration absorber 415 is desired to be mounted on the first frame member 10*a* which directly supports the touch roller 11; the closer towards the forward end, the more effectively vibration damping is performed. As illustrated, the plate spring 418 is of a bow type, with its lower end bolted to the first frame member 10*a* and with its upper end held in the contact with the side face of the weight 417. Also the plate springs 418, 418 are installed on both sides of the weight 417, and are connected by a screw pin 419 inserted through the hole 417*a* the weight 417. The spring force of the plate springs 418, 418 to the weight 417 can be adjusted by turning a nut 420 on this screw pin 419. The plate springs 418, 418 are held with a specific force in contact with the sides of the weight 417, giving an additional damping force. In this case, it should be understood that the means for imparting the damping force is not limited only to the plate springs, but a dash pot for example may be used.

Figure 20:
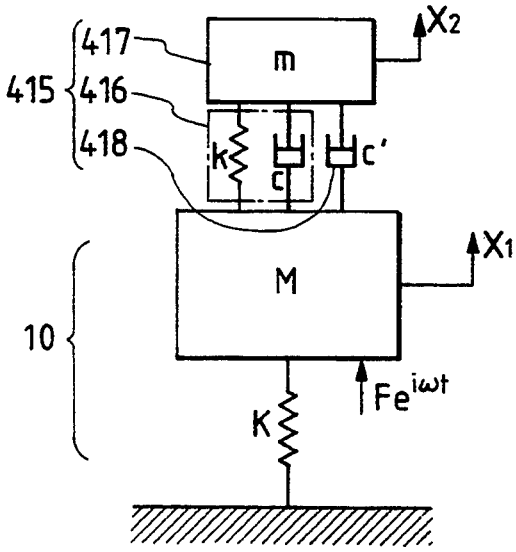
* and FIG. 20 is a view showing a model of the vibration system of FIGS. 18*a*, 18*b*.

Referring to FIG. 20, a model of the elevating frame 10 on which the dynamic vibration absorber 415 is mounted will be explained. The iron weight 317 is of the mass m; the rubber cushions 316 has a spring constant k and a damping constant c; the plate springs 318 have an additional damping constant c'; and the elevating frame 10 serves as a spring having a spring constant K which is determined by a weight having a mass M and its support construction. In this model, the optimum design condition of the dynamic vibration absorber 315 will satisfy the following formulas (1) and (2).

$$\text{Optimum natural frequency} = (1/(1+\mu)) \times \Omega_n \quad (1)$$

$$\text{Optimum damping ratio} = (3\mu/8(1+\mu)^{\frac{1}{2}} \quad (2)$$

where $\mu$: Mass ratio of iron block and elevating frame (m/M)

$\mu_n$: Natural frequency of elevating frame $((K/M)^{\frac{1}{2}})$

That is, since the damping constant c is low, the additional damping constant c' is added (c +c' to make the formula (2) to thereby provide the optimum conditions.

Figure 14:
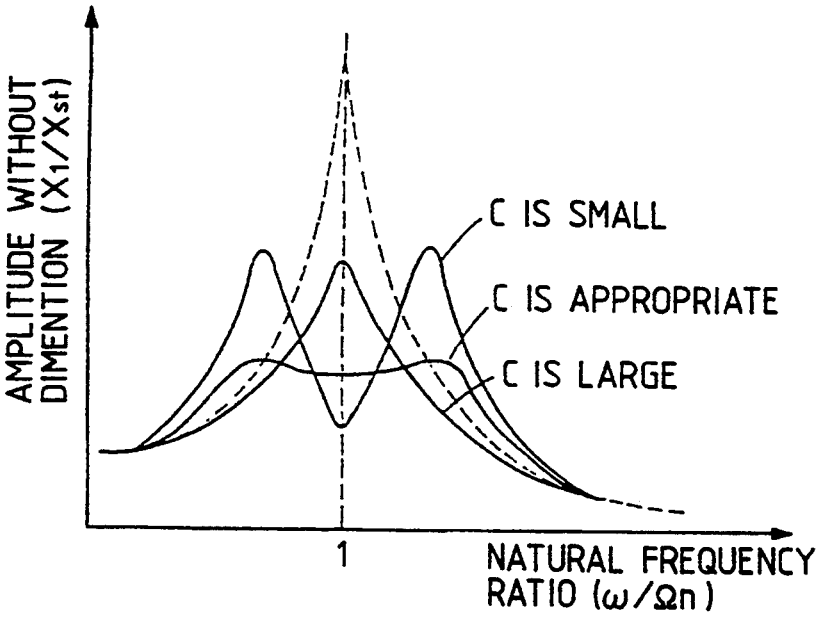
FIG. 14 is a graph showing a vibration frequency response pattern.

The vibration frequency response pattern of the elevating frame mounted with such a dynamic vibration absorber is the same as that shown in FIG. 14.

The vibration restraining device of the yarn take-up machine of the present invention has a dynamic vibration absorber consisting of a weight, a rubber cushion connected to this weight, and an additional damping imparting means, mounted in the vicinity of the forward end of the frame member of the yarn take-up machine having a frame member for holding a touch roller which is rotating in contact with a package. The additional damping imparting means adds a damping force to compensate for the damping constant of a common rubber cushion which is likely to lack, thereby restraining the resonance of the frame member of the yarn take-up machine with an adequate spring constant and damping constant to the weight; therefore the yarn take-up machine can be freed from the design limit of natural frequency of the elevating frame, thus becoming usable within a wide range of take-up speeds from low to high. Furthermore, since the adjustment of the additional damping imparting means can freely set the damping constant, the optimum vibration restraining device for yarn take-up machines of different sizes can be designed with ease.

What is claimed is:

1. A yarn take-up machine, comprising:

a machine frame, at least one cantilevered bobbin holder mounted on the machine frame for holding at least one bobbin on which a package is formed, the at least one cantilevered bobbin holder defining a free end, a touch roller for rotating in contact with the bobbin holder, a vertically moveable frame member supported on the machine frame for holding the touch roller, the frame member defining a top portion, and a dynamic vibration absorber mounted on the top portion of the frame member at a region substantially adjacent the free end of the bobbin holder for reducing vibration of the frame member, the dynamic vibration absorber comprising at least one rubber member in contact with the frame member and a weight in contact with the at least one rubber member.

2. The machine of claim 1, comprising a cover for hermetically enclosing the dynamic vibration absorber.

3. The machine of claim 1, wherein the frame member defines a first end and a second end, wherein the frame member is supported on the machine frame through the second end, and wherein the dynamic vibration absorber is mounted substantially adjacent the first end of the frame member.

4. The machine of claim 1, wherein the at least one rubber member comprises a plurality of rubber cushions connected to the weight.

5. A yarn take-up machine, comprising:

a machine frame, at least one cantilevered bobbin holder mounted on the machine frame for holding at least one bobbin on which a package is formed, a touch roller for rotating in contact with the bobbin holder, a frame member supported on the machine frame for holding the touch roller, and a dynamic vibration absorber mounted the frame member for reducing vibration of the frame member, the dynamic vibration absorber comprising a weight and a plurality of rubber cushions connected to the weight, wherein the weight defines a lower surface, wherein the rubber cushions define a lower end, wherein the weight is provided with substantially cylindrical holes in which the rubber cushions are embedded, and further comprising at least one plastic sheet disposed between the lower end of the rubber cushions and the lower surface of the weight, whereby the rubber cushions are enclosed within a substantially hermetically closed space.

* * * * *